US009031486B2

(12) United States Patent
Usui et al.

(10) Patent No.: US 9,031,486 B2
(45) Date of Patent: May 12, 2015

(54) FIXING DEVICE FOR EFFICIENTLY HEATING OF HEATING MEMBER

(71) Applicant: Kyocera Document Solutions Inc., Osaka (JP)

(72) Inventors: Shogo Usui, Osaka (JP); Satoshi Ishii, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/093,067

(22) Filed: Nov. 29, 2013

(65) Prior Publication Data

US 2014/0153984 A1 Jun. 5, 2014

(30) Foreign Application Priority Data

Nov. 30, 2012 (JP) ..... 2012-262799

(51) Int. Cl.
*G03G 15/20* (2006.01)

(52) U.S. Cl.
CPC .... *G03G 15/2053* (2013.01); *G03G 2215/2032* (2013.01)

(58) Field of Classification Search
CPC ..... G03G 15/2015; G03G 15/2017; G03G 2215/2042; G03G 15/2078; G03G 2215/2041
USPC ..... 399/329, 67, 328, 330, 33, 70
See application file for complete search history.

(56) References Cited

U.S. PATENT DOCUMENTS

| | | | | |
|---|---|---|---|---|
| 7,369,804 | B2 * | 5/2008 | Yasuda et al. | 399/330 |
| 2010/0272483 | A1 * | 10/2010 | Nanjo | 399/331 |
| 2013/0251423 | A1 * | 9/2013 | Nanjo et al. | 399/330 |

FOREIGN PATENT DOCUMENTS

| | | | |
|---|---|---|---|
| JP | 2003-077645 | A | 3/2003 |
| JP | 2006-163200 | A | 6/2006 |
| JP | 2009-162994 | A | 7/2009 |

* cited by examiner

*Primary Examiner* — Roy Y Yi
(74) *Attorney, Agent, or Firm* — Ostrolenk Faber LLP

(57) ABSTRACT

A fixing device includes a pressure member, a heating member, a coil, a first magnetic core, a second magnetic core, a shielding portion, and a switching belt. The second magnetic core is disposed to extend in a width direction in a hollow portion formed by the loop of the coil, and formed in an arc shape with a protruding portion at a side facing the heating member. The shielding portion is formed of a non-magnetic material to shield a path of a magnetic flux generated by the coil between the second magnetic core and the heating member. The switching belt includes a surface where the shielding portion is disposed to face a non-paper passing region in the heating member, suspended to be rotatable between a roller and the protruding portion, and selectively arranged in one of a shielding position and a non-shielding position by rotation of the roller.

16 Claims, 7 Drawing Sheets

FIXING DEVICE FOR EFFICIENTLY HEATING OF HEATING MEMBER

REFERENCE TO RELATED APPLICATION

This application is based upon, and claims the benefit of priority from, corresponding Japanese Patent Application No. 2012-262799 filed in the Japan Patent Office on Nov. 30, 2012, the entire contents of which are incorporated herein by reference.

BACKGROUND

Unless otherwise indicated herein, the description in this section is not prior art to the claims in this application and is not admitted to be prior art by inclusion in this section.

An electromagnetic-induction heating type fixing device generates magnetic flux with an excitation coil so as to cause an eddy current in an induction heating layer provided within a heating member. The eddy current generates Joule heat to heat the induction heating layer, thus heating the heating member to a predetermined fixing temperature. This type of fixing device can reduce the thermal capacity of the induction heating layer to shorten warm-up time for starting the device, and to ensure a compact device and high thermal conversion efficiency. However, in cases where a printing sheet to be fixing processed is of small size, in the sheet-passing region through which printing sheets pass, the printing sheets absorb heat from the surface of the heating member such that the heating member loses heat. On the other hand, the sheet non-passing regions through which printing sheets do not pass is in a high-temperature state. Especially in the case where printing sheets pass through continuously, when the sheet-passing region of the heating member is maintained at the fixing temperature, the temperature of the sheet non-passing region of the heating member rises excessively, such that the temperatures of the heating member and the excitation coil exceed their heat-resistance limit temperatures. This can result in drawbacks such as thermal failure of these components.

Fixing devices have been proposed to solve the above-described drawbacks. For example, one fixing device includes a coil, a magnetic core, and a shielding member. The coil generates magnetic flux for induction heating of the heating member. The magnetic core is disposed on the opposite side of the coil from the heating member, and surrounds the coil. The shielding member is disposed between the coil and the magnetic core in a position facing the sheet non-passing region for smaller-size printing sheets so as to shield the path of the magnetic flux. During a fixing process on a printing sheet with the maximum sheet-passing width, the shielding member is located at a magnetic path freeing position in the wound part of the coil. During a fixing process on a printing sheet with a small width, the shielding member moves into a magnetic path shielding position, which is at the center of the coil windings. Disposing the shielding member in the magnetic path shielding position during the fixing process on printing sheets of small width weakens by means of the shielding member the magnetic flux acting on the sheet non-passing region. This reduces heat generation in the heating member in the sheet non-passing region.

Another exemplary fixing device includes a coil, which generates magnetic flux for induction heating of the inner periphery of a heating roller, and a flexible shielding member between the coil and the inner peripheral surface of the heating roller. The heating roller has an end on which a winding roller, which winds up and houses the shielding member, is disposed. During a fixing process on a printing sheet of maximum sheet-passing width, the shielding member is wound in by the winding roller and then housed. During a fixing process on printing sheets of small width, the shielding member is arranged to shield a part of the magnetic flux from the coil toward sheet-passing portion of the heating roller. This weakens by means of the shielding member the magnetic flux acting on the sheet non-passing region, thus reducing heat generation in the sheet non-passing regions of the heating roller.

Another exemplary fixing device includes a coil, a first magnetic core, and a second magnetic core. The coil generates magnetic flux for induction heating of a heating member. The first magnetic core surrounds the coil and forms a magnetic path. The second magnetic core is disposed in the hollow portion of a loop-shaped coil, and forms a magnetic path. The second magnetic core is rotatable and has a cylindrical cross section. A shielding member is mounted on the outer peripheral surface of the second magnetic core. At a position in a portion of the second magnetic core along its periphery, the shielding member is disposed facing a sheet non-passing region to the outer side of the sheet-passing region of printing sheets of small width. During a fixing process on a printing sheet with the maximum sheet-passing width, the shielding member moves into a position most separated from the heating member. During a fixing process on a printing sheet of small width, rotation of the second magnetic core moves the shielding member into a shielding position close to the surface of the heating member. Arranging the shielding member in the shielding position during the fixing process on paper sheets of small width weakens by means of the shielding member the magnetic flux acting on the non-paper passing region, thus reducing heat generation in the non-paper passing region of the heating member.

Further, another exemplary fixing device includes a loop-shaped coil, a first magnetic core, and a second magnetic core. The coil generates magnetic flux for induction heating of a heating member. The first magnetic core surrounds the coil and forms a magnetic path. The second magnetic core is disposed in the hollow portion of the coil, and forms a magnetic path. An endless belt is suspended between the second magnetic core, which is rectangular in cross section, and a rotationally driving roller. On a surface of the belt, a shielding member that shields the path of the magnetic flux is disposed. The shielding member covers over an area of the second magnetic core corresponding to a sheet non-passing region to the outer side of the sheet-passing region of printing sheets of small width. Arranging the shielding member in the magnetic path between the second magnetic core and the heating member during a fixing process on a printing sheet of small width weakens by means of the shielding member the magnetic flux acting on the sheet non-passing region, thus reducing heat generation in the non-paper passing region of the heating member.

SUMMARY

A fixing device according to an exemplary embodiment in the present disclosure includes a pressure member, a heating member, a coil, a first magnetic core, a second magnetic core, a rotationally driving roller, a shielding portion, and an endless switching belt. The heating member is brought into pressure contact with the pressure member so as to form a nipping area. The coil is wound in the form of a loop, widthwise perpendicular to the conveyance direction of a recording medium, in the heating member to generate magnetic flux for induction heating of the heating member. The first magnetic core surrounds the coil on an side of the coil opposite from the heating member, so as to form a magnetic path. The second magnetic core is disposed extending widthwise between the first magnetic core and the heating member, in the hollow portion formed by the coil loop, so as to form a magnetic path with the first magnetic core. The second magnetic core is formed in an arcuate shape and having a protruding portion along a side of the second magnetic core facing the heating member. The rotationally driving roller is disposed alongside a recessed portion of the second magnetic core, on a the side thereof reverse from the protruding portion. The shielding portion is formed of a non-magnetic material to shield the path of the magnetic flux generated by the coil between the second magnetic core and the heating member. The endless switching belt allows passing of the magnetic flux. The switching belt includes a surface where the shielding portion is provided facing a sheet non-passing region of the heating member. The sheet non-passing region is a region to the outer side of a sheet-passing region through which passes recording media of width smaller than maximum-width recording media that are inserted through the nipping area. The switching belt is rotatably suspended between a rotationally driving roller and the protruding portion of the second magnetic core. The switching belt is configured to be selectively disposed by rotation of the roller in one of either a shielding position or a non-shielding position. The shielding position allows the shielding portion to shield the magnetic flux between the second magnetic core and the heating member. The non-shielding position allows passing of the magnetic flux between the second magnetic core and the heating member.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
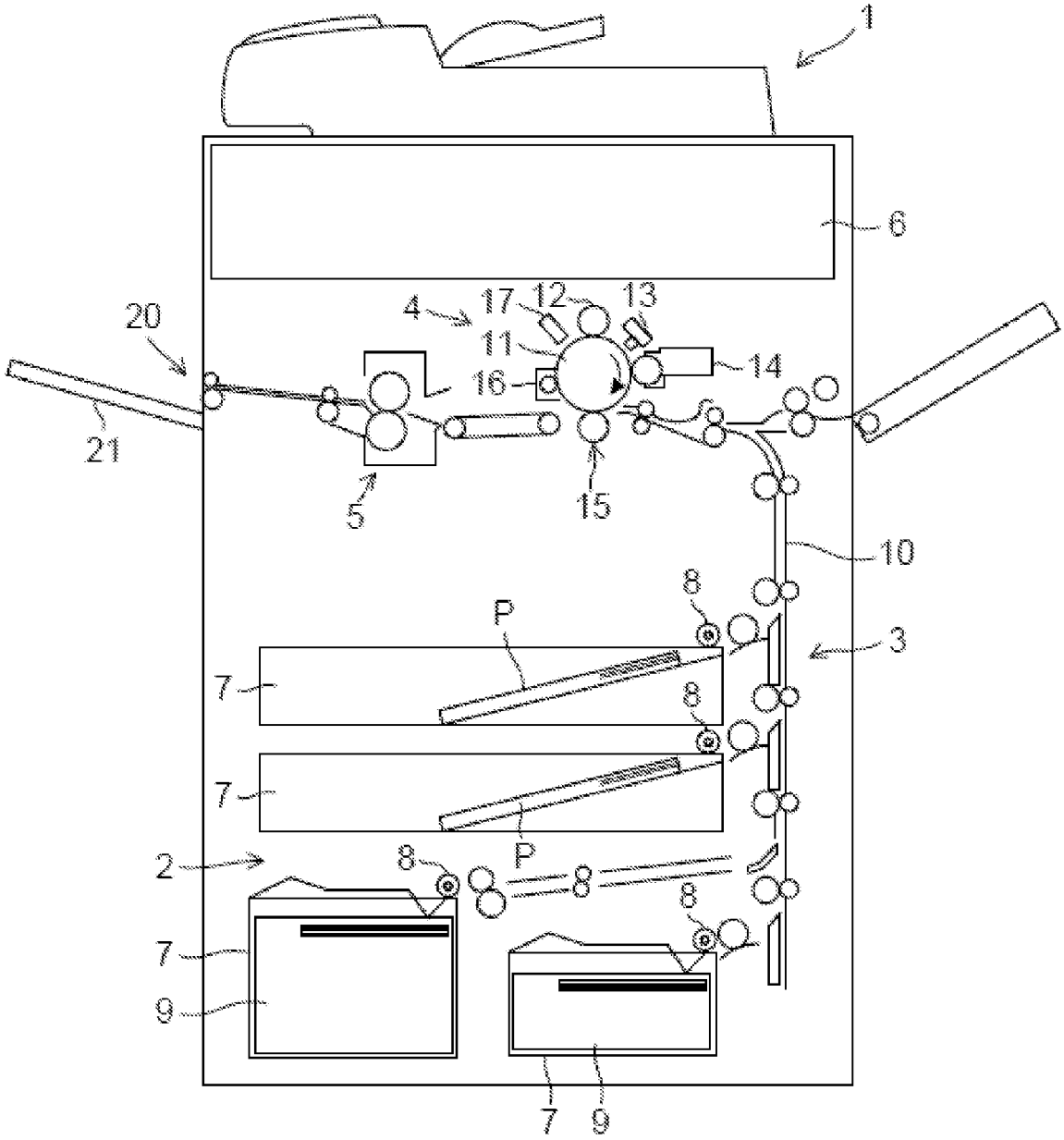
FIG. 1 is a cross-sectional view illustrating an overall configuration of an image forming apparatus including a fixing device according to an embodiment of the present disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Hereinafter, embodiments of the present disclosure are described with reference to the attached drawings, but the embodiment of the present disclosure is not limited to the embodiments described as examples here. In addition, for example, applications of the embodiment of the present disclosure and terms described here are not limited to those in the embodiments.

FIG. 1 is a cross-sectional view illustrating a configuration of an image forming apparatus including a fixing device according to an embodiment of the present disclosure. An image forming apparatus 1 includes a printing sheet feeder 2, a printing sheet conveyor 3, an image forming unit 4, a fixing device 5, and an image reading unit 6. The printing sheet feeder 2 is disposed in a lower part of the image forming apparatus 1. The printing sheet conveyor 3 is disposed to the side of the printing sheet feeder 2. The image forming unit 4 is disposed above the printing sheet conveyor 3. The fixing device 5 is disposed at a discharge side of a printing sheet with respect to the image forming unit 4. The image reading unit 6 is disposed above the image forming unit 4 and the fixing device 5.

The printing sheet feeder 2 includes a plurality of sheet feed cassettes 7 that each house printing sheets P as a recording medium. Rotation of a paper feed roller 8 sends out the printing sheets P one by one to the printing sheet conveyor 3 from a selected sheet feed cassette 7 among the plurality of sheet feed cassettes 7.

The printing sheet P sent to the printing sheet conveyor 3 is conveyed to the image forming unit 4 via a sheet conveying path 10 included in the printing sheet conveyor 3. The image forming unit 4 forms a toner image on the printing sheet P by an electrophotographic process. The image forming unit 4 includes a photoreceptor 11 supported to rotate in an arrow direction in FIG. 1, and includes a charging unit 12, an exposing unit 13, a developing unit 14, a transfer unit 15, a cleaning unit 16, and a static electricity removing unit 17 around the photoreceptor 11 along the rotation direction.

The charging unit 12 includes a charging roller to which a high voltage is applied. When the charging unit 12 applies a predetermined potential to the surface of the photoreceptor 11 from the charging roller in contact with a surface of the photoreceptor 11, the surface of the photoreceptor 11 is uniformly charged. When the photoreceptor 11 is irradiated with a light from the exposing unit 13 based on image data of a document read by the image reading unit 6, the surface potential of the photoreceptor 11 is selectively attenuated so that an electrostatic latent image is formed on the surface of the photoreceptor 11.

The developing unit 14 develops the electrostatic latent image on the surface of the photoreceptor 11. This forms a toner image on the surface of the photoreceptor 11. This toner image is transferred by the transfer unit 15 onto the printing sheet P fed in between the photoreceptor 11 and the transfer unit 15.

The printing sheet P, onto which the toner image is transferred, is conveyed toward the fixing device 5 disposed on the downstream side of the image forming unit 4 in a printing sheet conveying direction. In the fixing device 5, the printing sheet P is heated and pressed so as to melt and fix the toner image on the printing sheet P. Subsequently, the printing sheet P, on which the toner image is fixed, is discharged onto a discharge tray 21 by a discharge roller pair 20.

After the toner image is transferred onto the printing sheet P by the transfer unit 15, the toner remaining on the surface of the photoreceptor 11 is removed by the cleaning unit 16. Residual charge on the surface of the photoreceptor 11 is removed by the static electricity removing unit 17. Subsequently, the photoreceptor 11 is charged again by the charging unit 12. Then, image formation is performed in the same manner.

Figure 2:
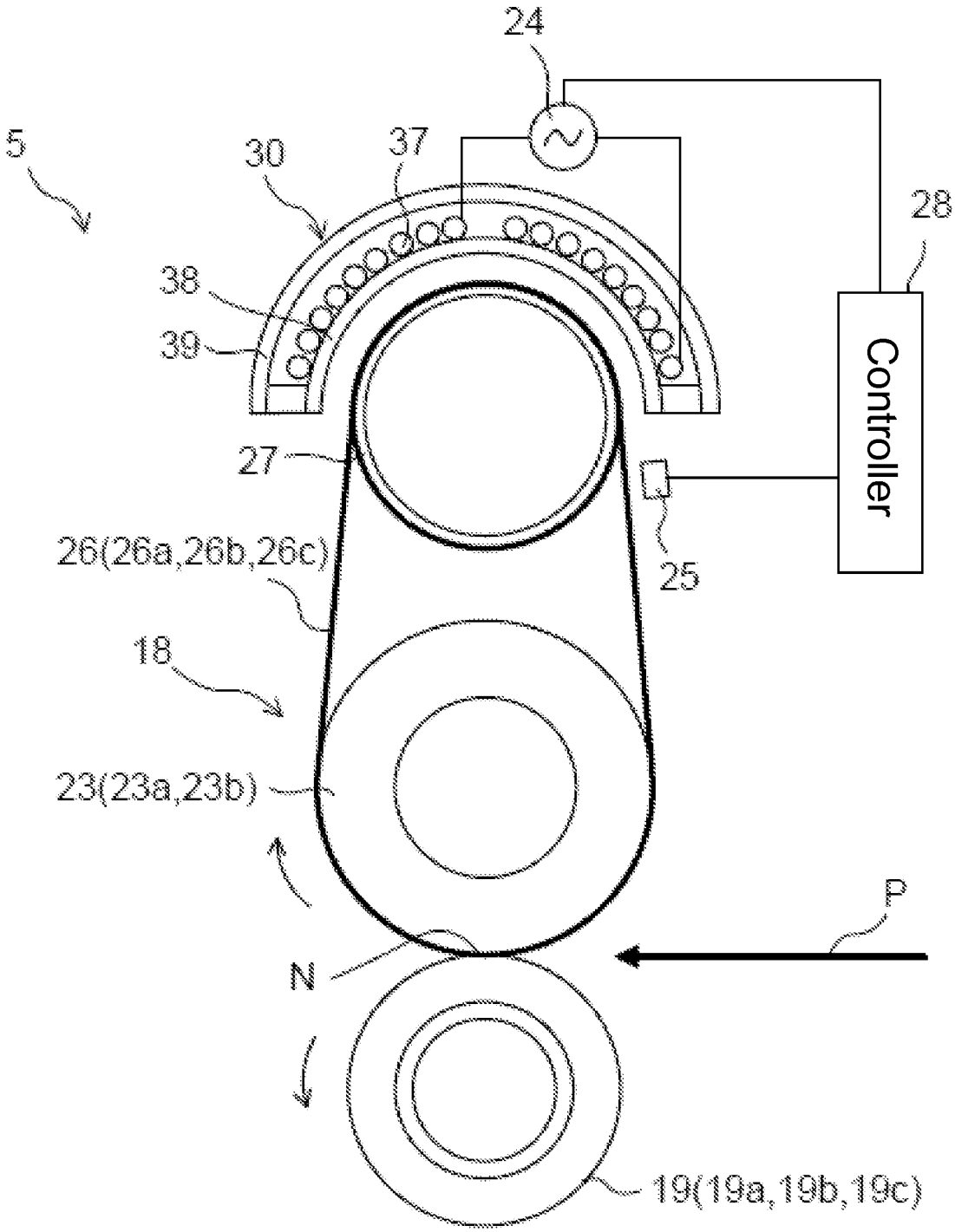
FIG. 2 is a side cross-sectional view illustrating a configuration of the fixing device according to the embodiment.

The fixing device 5 is constituted as illustrated in FIG. 2. FIG. 2 is a side cross-sectional view illustrating a configuration of the fixing device 5.

The fixing device 5 employs an electromagnetic induction heating scheme. The fixing device 5 includes a heating portion 18 and a pressure roller 19 as a pressure member. The heating portion 18 includes an endless heating belt 26 as a heating member, a fixing roller 23, a suspension roller 27, and an induction heating unit 30. The fixing roller 23 is disposed along the inner periphery of the heating belt 26. The suspension roller 27 suspends the fixing roller 23 together with the heating belt 26. The induction heating unit 30 is disposed to face the suspension roller 27 at an outer periphery of the heating belt 26. Additionally, the fixing device 5 includes a power supply 24, a thermistor 25, and a controller 28. The power supply 24 is coupled to the induction heating unit 30. The thermistor 25 senses the temperature of the outer peripheral surface of the heating belt 26. The controller 28 controls current supplied from the power supply 24 based on the sensed temperature by the thermistor 25.

The pressure roller 19 is driven to rotate by a drive source (not shown) such as a motor in an arrow direction of FIG. 2. The pressure roller 19 presses the fixing roller 23 toward the center of the fixing roller 23. Accordingly, the pressure roller 19 and the fixing roller 23 push each other via the heating belt 26. In the pushing state of the pressure roller 19 and the fixing roller 23, rotatably driving the pressure roller 19 rotates the heating belt 26 and the fixing roller 23 in the arrow direction of FIG. 2. Further, the suspension roller 27 rotates driven along with the rotation of the heating belt 26. A nip portion N is formed in an area where the heating belt 26 and the pressure roller 19 are in contact with each other while rotating in directions opposite from each other. In this nip portion N, the printing sheet P is sandwiched. The sandwiched printing sheet P is heated and pressed so as to melt and fix the toner in a powder state on the printing sheet P.

The pressure roller 19 includes a cylindrical cored bar 19*a*, an elastic layer 19*b* formed on the cored bar 19*a*, and a release layer 19*c*, which covers a surface of the elastic layer 19*b*. For example, the cored bar 19*a* is set to have an outer diameter of 46 mm, a thickness of 3 mm, and a length of 372 mm in a width direction perpendicular to the conveying direction of the printing sheet P. On the cored bar 19*a* made of aluminum, the elastic layer 19*b* made of silicone rubber is formed with, for example, a thickness of 2 mm. On the elastic layer 19*b*, the release layer 19*c* is formed with a thickness of 30 μm using a fluororesin tube for example.

The fixing roller 23 is brought into pressure contact with the inner peripheral surface of the heating belt 26 to rotate with the heating belt 26. For example, the fixing roller 23 includes an elastic layer 23*b* made of silicone rubber with a thickness of 9 mm on a cored bar 23*a* made of aluminum with an outer diameter of 27 mm, a width direction length of 370 mm, and a thickness of 2 mm. The elastic layer 23*b* suspends the heating belt 26.

The suspension roller 27 is brought into pressure contact with the inner peripheral surface of the heating belt 26 to rotate with the heating belt 26. For example, the suspension roller 27 is set to have an outer diameter of 30 mm and a width direction length of 360 mm, and formed using an aluminum tube with a thickness of 0.3 mm.

The heating belt 26 is formed using an endless heat resistant belt with, for example, an inner diameter of 65 mm and a width direction length of 360 mm in a circular state. The heating belt 26 is constituted such that an induction heating layer 26*a*, an elastic layer 26*b*, and a release layer 26*c* are laminated in this order from the inner periphery side. The induction heating layer 26*a* is formed using electroformed nickel with a thickness of 35 μm. The elastic layer 26*b* is formed using silicone rubber and similar material with a thickness of 300 μm. The release layer 26*c* is formed using a fluoropolymer tube with a thickness 300 μm, and improves release property when an unfixed toner image is melted and fixed in the nip portion N.

The induction heating unit 30 includes an excitation coil 37, a bobbin 38, and a magnetic core 39 to heat the heating belt 26 by electromagnetic induction. The induction heating unit 30 extends in a longitudinal direction (front and back direction of the paper of FIG. 2, and the width direction of the heating belt 26), and is disposed facing the heating belt 26 to surround approximately a half of an outer periphery of the suspension roller 27.

The excitation coil 37 is mounted on the bobbin 38 by winding Litz wire several times in a loop shape along the width direction of the heating belt 26. The excitation coil 37 is coupled to the power supply 24 so as to generate an alternating magnetic flux using a high frequency current supplied from the power supply 24. The magnetic flux from the excitation coil 37 passes through the magnetic core 39, is guided in a direction parallel to the paper of FIG. 2, and passes along the induction heating layer 26*a* of the heating belt 26. Eddy current is generated in the induction heating layer 26*a* by alternating change in intensity of the magnetic flux passing through the induction heating layer 26*a*. Flow of the eddy current in the induction heating layer 26*a* generates Joule heat by electrical resistance of the induction heating layer 26*a* so that the heating belt 26 generates heat.

When the heating belt 26 is heated by the induction heating unit 30 to a predetermined temperature, the printing sheet P sandwiched in the nip portion N is heated and also pressed by the pressure roller 19. As a result, the toner in a powder state on the printing sheet P is melted and fixed to the printing sheet P. Accordingly, the heating belt 26 is formed using a thin material with good thermal conductivity and has a small thermal capacity. The fixing device 5 can go into a start-up state in a short time, thus rapidly starting image formation.

Figure 3:
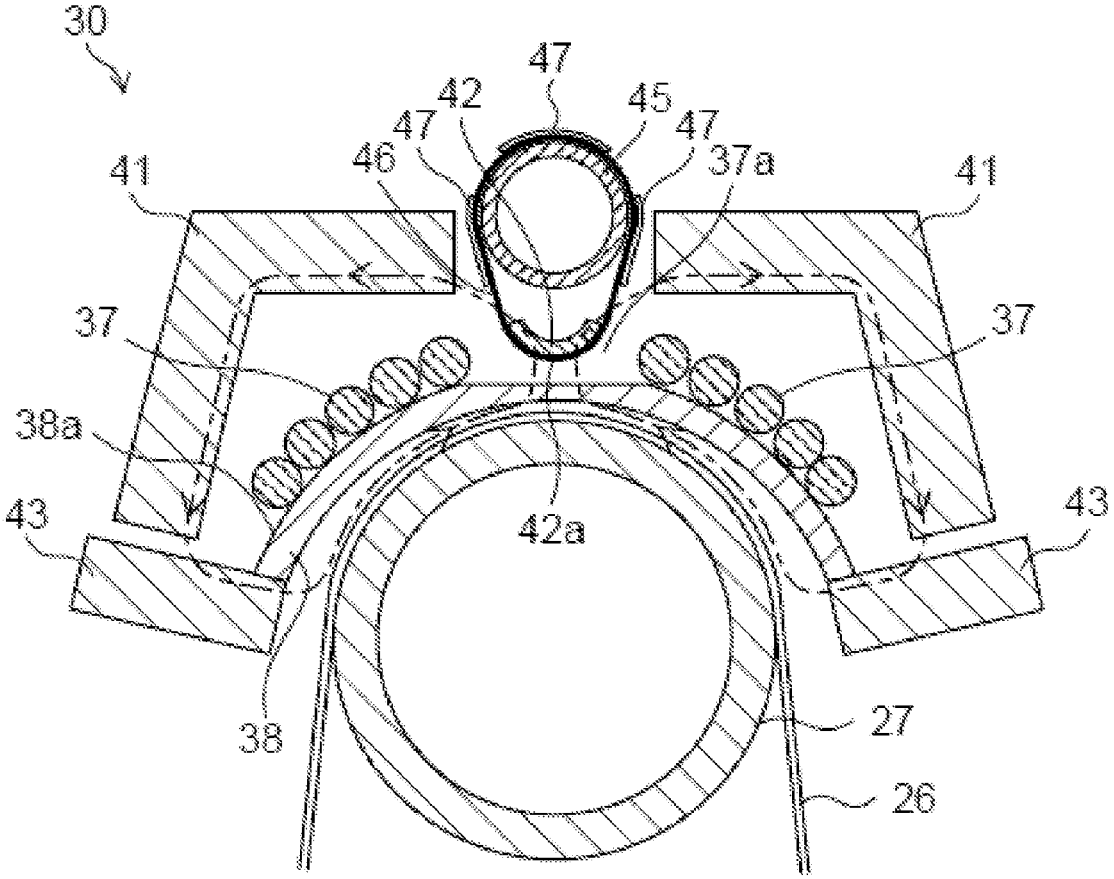
FIG. 3 is a side cross-sectional view illustrating an induction heating unit of the fixing device according to the embodiment.

A detailed configuration of the induction heating unit 30 is illustrated in FIG. 3. FIG. 3 is a side cross-sectional view illustrating the induction heating unit 30.

The induction heating unit 30 includes the coil 37, the bobbin 38 as a supporting member, and the magnetic core 39 as described above. The magnetic core 39 includes a first magnetic core 41, a second magnetic core 42, and a third magnetic core 43. Additionally, the induction heating unit 30 includes an endless switching belt 46 suspended between the second magnetic core 42 and a roller 45.

The bobbin 38 is disposed coaxially with the rotation center axis of the suspension roller 27 at a predetermined space with the surface of the heating belt 26, and disposed to surround approximately a half of an circumference surface of the suspension roller 27. The bobbin 38 is formed of heat resistant resin such as liquid crystal polymer resin (LCP resin), polyethylene terephthalate resin (PET resin), and polyphenylene sulfide resin (PPS resin). Accordingly, for example, the bobbin 38 provides heat resistance against heat radiation from the heating belt 26.

The coil 37 employs, for example, Litz wire coated by a fusing layer. The coil 37 is wound in a loop shape along a longitudinal direction (front and back direction of the paper of FIG. 3) to have an arc-shaped cross section along a mounting surface 38*a* of the bobbin 38. Subsequently, the coil 37 is heated to melt the fusing layer, and then cooled to be formed in a predetermined shape (a loop shape). The coil 37 may be, for example, secured onto the mounting surface 38*a* using silicone-based adhesive or similar adhesive.

The first magnetic core 41 employs a high magnetic permeability ferrite such as a manganese-zinc ferrite, and is formed in a rectangular shape with an L-shaped cross section. The first magnetic core 41 is set to have, for example, a width (the length in the width direction of the heating belt 26) of 10 mm and a thickness of 4.5 mm. A pair of the first magnetic cores 41 are arranged on both sides of the second magnetic core 42 and the roller 45 in positions symmetrical to each other with respect to the second magnetic core 42 and the roller 45. A plurality (for example, 15 sets) of pairs of the first magnetic cores 41 are equally spaced in the width direction of the heating belt 26 to face the coil 37. The first magnetic core 41 is mounted on a supporting member (not shown) integrated with the bobbin 38.

The third magnetic core 43 employs a high magnetic permeability ferrite such as a manganese-zinc ferrite, and is formed in a rectangular parallelepiped shape. The third magnetic core 43 is set to have, for example, a length (the length in the width direction of the heating belt 26) of 38 mm, a width of 13 mm, and a thickness of 4 mm. Respective pluralities (for example, 10) of the third magnetic cores 43 are mounted on both sides of the bobbin 38, while the third magnetic cores 43 are arranged with their side surfaces in contact with one another along the width direction of the heating belt 26.

The first magnetic cores 41 and the third magnetic cores 43 are mounted in respective predetermined positions at the bobbin 38 and the supporting member (not shown) integrated with the bobbin 38 so as to surround an outer side of the coil 37. When the coil 37 generates a magnetic flux using a high frequency current, the first magnetic cores 41 and the third magnetic cores 43 form magnetic paths in respective predetermined directions.

The second magnetic core 42 employs a high magnetic permeability ferrite such as a manganese-zinc ferrite, and is formed in an arc shape with a semicircular cross section. For example, the arc has an outer diameter of 10 mm, a thickness of 3 to 4 mm, a center angle of 45°. The second magnetic core 42 is disposed corresponding to the entire region in the width direction of the heating belt 26. The second magnetic core 42 is arranged between the first magnetic core 41 and the bobbin 38 in a hollow portion 37*a* formed in the loop of the wound coil 37. The arc includes a protruding portion 42*a* arranged toward the heating belt 26 side. The second magnetic core 42 is mounted on the supporting member (not shown) integrated with the bobbin 38 using silicone-based adhesive or similar adhesive. When the coil 37 generates the magnetic flux using a high frequency current, the second magnetic core 42 forms a magnetic path in a predetermined direction.

The roller 45 faces the second magnetic core 42 and is disposed to extend between the pair of the first magnetic cores 41 in the width direction of the heating belt 26. The roller 45 is formed using an aluminum tube with, for example, an outer diameter of 20 mm and a thickness of 3 mm. The roller 45 is rotatably supported by the supporting member (not shown). The roller 45 is coupled to a drive source such as a motor (not shown), and is rotatably driven by the motor so as to rotate.

The switching belt 46 is suspended between the roller 45 and the protruding portion 42*a* of the second magnetic core 42, and rotatably driven by the roller 45 so as to rotate. The switching belt 46 employs a magnetic sheet of heat resistant resin such as polyimide resin containing ferrite powder, and is formed in an endless shape with a length equal to or more than the width direction length of the heating belt 26. When the coil 37 generates the magnetic flux using a high frequency current, the magnetic flux passes through a surface of the switching belt 46 containing ferrite powder.

The switching belt 46 has an external surface to which the shielding portion 47 is attached with silicone-based adhesive or similar adhesive.

The shielding portion 47 employs a non-magnetic material with a good conductive property, for example, copper, and is formed in a sheet shape (for example, with a thickness of 80 μm). Since the shielding portion 47 is non-magnetic, the shielding portion 47 shields a magnetic flux perpendicularly passes through the surface of the non-magnetic shielding portion 47 by cancelling with a magnetic flux in the reverse direction, which is generated with induced current by the magnetic flux perpendicularly passes through the surface of the non-magnetic shielding portion 47. The shielding portion 47 with conductive property reduces Joule heat generation by the induced current, thus efficiently shielding the magnetic flux. The shielding portion 47 is disposed in a part of the switching belt 46 in a winding direction and disposed at an end in the width direction of the switching belt 46.

Figure 4:
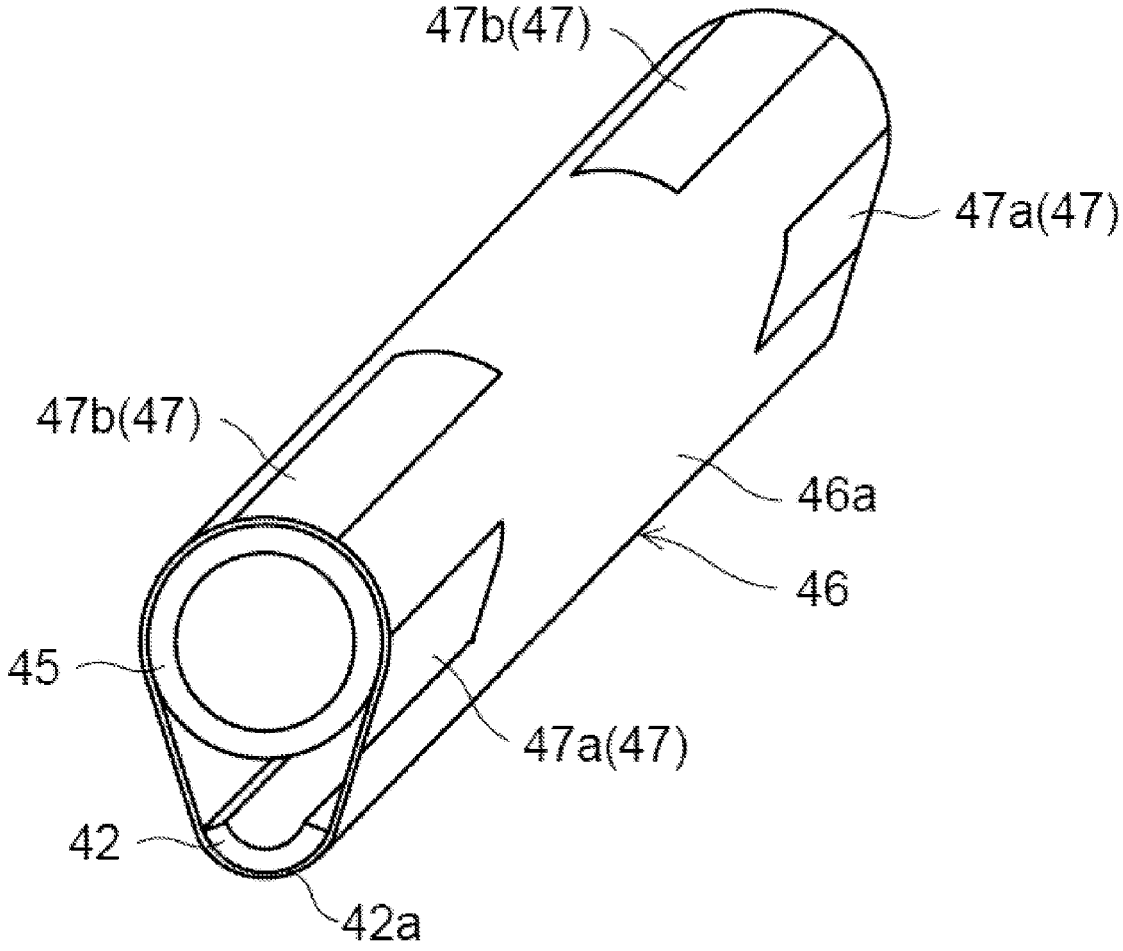
FIG. 4 is a perspective view illustrating a switching belt suspended between a second magnetic core and a roller in the fixing device according to the embodiment.
Figure 5:
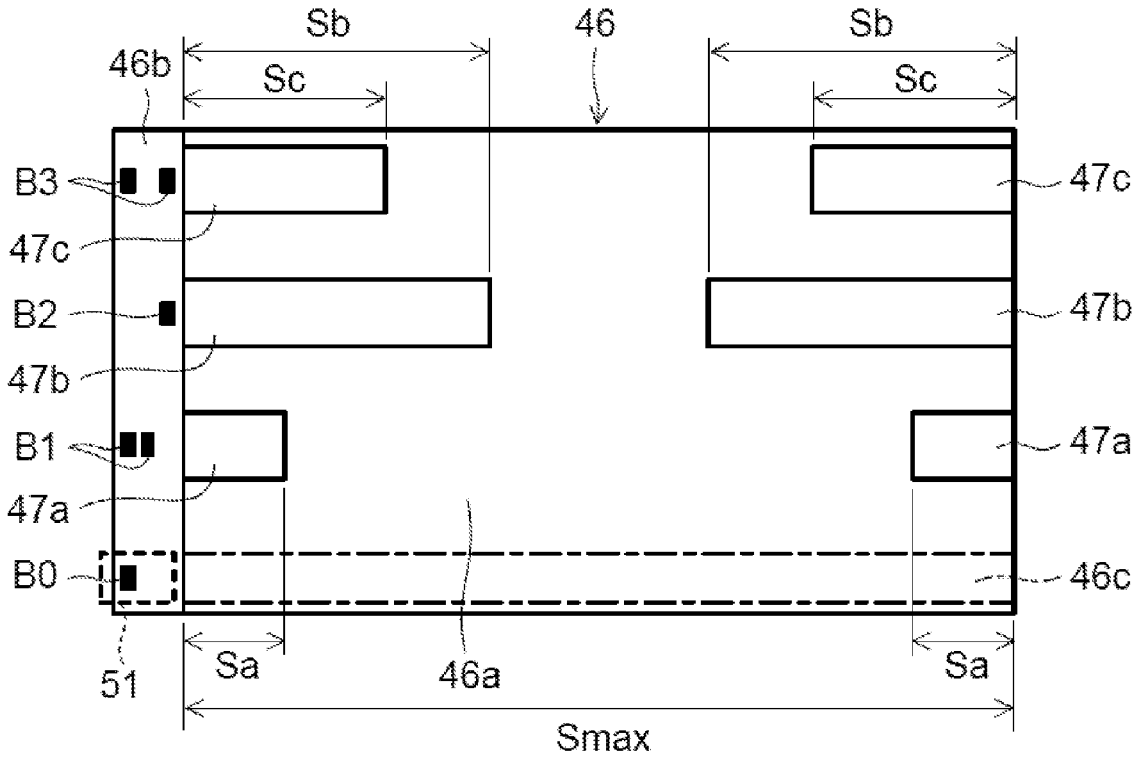
FIG. 5 is a plan view illustrating the switching belt of the fixing device in a rolled-out state according to the embodiment.

FIG. 4 and FIG. 5 each illustrate a detailed configuration of the switching belt 46. FIG. 4 is a perspective view illustrating the switching belt 46 suspended between the second magnetic core 42 and the roller 45. FIG. 5 is a plan view illustrating the endless switching belt 46 cut along the width direction and in a rolled-out state. In FIG. 4, a sensing target portion 46*b* is omitted.

As illustrated in FIG. 4, the roller 45 is arranged close to a depressed portion on the opposite side to the arc-shaped protruding portion 42*a* of the second magnetic core 42. The switching belt 46 is suspended between the roller 45 and the protruding portion 42*a* of the second magnetic core 42. The switching belt 46 includes a magnetic portion 46*a* containing ferrite powder as described above. The magnetic portion 46*a* has a surface to which the shielding portion 47 is attached. The shielding portion 47 includes, for example, a first shielding portion 47*a*, a second shielding portion 47*b*, and a third shielding portion 47*c* (see also FIG. 5). The first to third shielding portions 47*a*, 47*b*, and 47*c* are arranged on both ends of the magnetic portion 46*a* in a width direction, in respective pairs. The first to third shielding portions 47*a*, 47*b*, and 47*c* are different in length in the width direction corresponding to the width of the printing sheet P to be inserted through the nip portion N.

As illustrated in FIG. 5, the switching belt 46 includes the sensing target portion 46*b* that allows sensing a rotation stop position of the switching belt 46 in addition to the magnetic portion 46*a* where the shielding portion 47 is partially disposed.

The magnetic portion 46*a* has a width equal to or more than a width of the maximum paper passing region Smax of the printing sheet P with the maximum width to be inserted through the nip portion N. At the end side of the magnetic portion 46*a*, the first shielding portion 47*a*, the second shielding portion 47*b*, and the third shielding portion 47*c* are disposed at predetermined spaces in the winding direction (up and down direction of FIG. 5). The first to third shielding portions 47*a* to 47*c* each have a length approximately equal to an outer peripheral length (a length in a peripheral direction) of the protruding portion 42*a* of the second magnetic core 42 (see FIG. 3) in the winding direction. When rotation of the roller 45 (see FIG. 3) rotates the switching belt 46 so that the first to third shielding portions 47*a* to 47*c* are stopped in a shielding position facing the protruding portion 42*a* of the second magnetic core 42, the magnetic path between the second magnetic core 42 and the heating belt 26 (see FIG. 3) is shielded by the first to third shielding portions 47*a* to 47*c*.

The first shielding portion 47*a* has a width corresponding to a first non-paper passing region Sa of the heating belt 26, which is formed by a first printing sheet P with a smaller width compared with the printing sheet P with the maximum width. When the first shielding portion 47*a* is held in the shielding position facing the protruding portion 42*a* of the second magnetic core 42, the magnetic path between the second magnetic core 42 and the heating belt 26 is formed in an area facing a region other than the first non-paper passing region Sa in the maximum paper passing region Smax while being shielded by the first shielding portion 47*a* in an area facing the first non-paper passing region Sa.

The second shielding portion 47*b* has a width corresponding to a second non-paper passing region Sb of the heating belt 26, which is formed by a second printing sheet P with a smaller width compared with the first printing sheet P. When the second shielding portion 47*b* is held in the shielding position facing the protruding portion 42*a* of the second magnetic core 42 and the coil 37 generates the magnetic flux, the magnetic path between the second magnetic core 42 and the heating belt 26 is formed in an area facing a region other than the second non-paper passing region Sb in the maximum paper passing region Smax while being shielded by the second shielding portion 47*b* in an area facing the second non-paper passing region Sb.

The third shielding portion 47*c* has a width corresponding to a third non-paper passing region Sc of the heating belt 26, which is formed by a third printing sheet P with a width smaller than the width of the first printing sheet P and larger than the width of the second printing sheet P. When the third shielding portion 47*c* is held in the shielding position facing the protruding portion 42*a* of the second magnetic core 42 and the coil 37 generates the magnetic flux, the magnetic path between the second magnetic core 42 and the heating belt 26 is formed in an area facing a region other than the third non-paper passing region Sc in the maximum paper passing region Smax while being shield by the third shielding portion 47*c* in an area facing the third non-paper passing region Sc.

For example, the first to third shielding portions 47*a*, 47*b*, and 47*c* may be disposed assuming that the first printing sheet P, the second printing sheet P, and the third printing sheet P are all standard-sized printing sheets. For example, the first shielding portion 47*a* may be disposed in a region corresponding to a region excluding the paper passing region with the width of the first printing sheet P from the maximum paper passing region Smax. Alternatively, the first shielding portion 47*a* may be disposed in a region corresponding to a region excluding the paper passing region of the first printing sheet P with a region slightly outside of the paper passing region of the first printing sheet P in the width direction from the maximum paper passing region Smax. For example, the maximum paper passing region Smax and the non-paper passing region may be set assuming that an A3 sheet as the printing sheet with the maximum width, a B4 sheet as the first printing sheet P, an A4 sheet as the second printing sheet P, and a B5 sheet as the third printing sheet P are longitudinally conveyed.

A magnetic region 46*c* is formed in a position (a lower side of the first shielding portion 47*a* in FIG. 5, and a part indicated by one-dot chain line) close to the first shielding portion 47*a*. The magnetic region 46*c* is constituted of a part of the magnetic portion 46*a*, and has a length equal to or more than the outer peripheral length of the protruding portion 42*a* of the second magnetic core 42 across the entire region of the maximum paper passing region Smax. When this magnetic region 46*c* is held in a position (referred to also as a non-shielding position) facing the protruding portion 42*a* of the second magnetic core 42, the magnetic path between the second magnetic core 42 and the heating belt 26 is formed across the entire region of the maximum paper passing region Smax.

The sensing target portion 46*b* is disposed adjacent to the first to third shielding portions 47*a* to 47*c* and the magnetic region 46*c*. In a position facing the sensing target portion 46*b*, a detection sensor 51 is disposed as a position sensing unit. The sensing target portion 46*b* includes reflecting surfaces B0, B1, B2, and B3 as reflecting portions respectively corresponding to the magnetic region 46*c* and the first to third shielding portions 47*a* to 47*c*. When the detection sensor 51 receives a reflected light from one reflecting surface among the reflecting surfaces B0, B1, B2, and B3, the detection sensor 51 senses that one region among the magnetic region 46*c* and the first to third shielding portions 47*a* to 47*c* faces the protruding portion 42*a* of the second magnetic core 42.

Specifically, the reflecting surfaces B0, B1, B2, and B3 are arranged on one end side of the switching belt 46. The reflecting surfaces B0, B1, B2, and B3 are respectively arranged corresponding to the magnetic region 46*c*, the first shielding portion 47*a*, the second shielding portion 47*b*, and the third shielding portion 47*c* in the up and down direction of FIG. 5. The reflecting surfaces B0, B1, B2, and B3 are each formed with a plurality of rectangular-shaped patterns (combinations of three patterns in this embodiment) arranged in the width direction (right and left direction of FIG. 5) of the switching belt 46. The reflecting surfaces B0, B1, B2, and B3 are formed on the surface of the switching belt 46 by, for example, aluminum coating. The detection sensor 51 is mounted on the supporting member (not shown). The detection sensor 51 includes a light projecting portion such as a light-emitting diode and a light receiving portion (for example, three units each constituted of the light projecting portion and the light receiving portion in this embodiment). The light receiving portion receives a reflected light of a light emitted from the light projecting portion by each pattern of the reflecting surfaces B0, B1, B2, and B3. For example, in the case where the reflecting surface B0 is located in a position facing the detection sensor 51, the detection sensor 51 outputs a signal corresponding to the pattern of the reflecting surface B0. Alternatively, in the case where the reflecting surface B1 is located in a position facing the detection sensor 51, the detection sensor 51 outputs a signal corresponding to the pattern of the reflecting surface B1. As described above, the detection sensor 51 outputs respective signals corresponding to the reflecting surfaces B0, B1, B2, and B3 to sense which region, among the magnetic region 46*c* and the first to third shielding portions 47*a* to 47*c*, faces the protruding portion 42*a* of the second magnetic core 42.

As illustrated in FIG. 3, during the fixing process on the printing sheet P with the maximum width, the switching belt 46 is held in the position where the shielding portion 47 (the first to third shielding portions 47*a* to 47*c* in FIG. 5) does not face the protruding portion 42*a* of the second magnetic core 42, that is, in the non-shielding position where the magnetic region 46*c* (see FIG. 5) faces the protruding portion 42*a* of the second magnetic core 42. In this case, in the entire region of the printing sheet P in the width direction, the magnetic flux generated by the coil 37 forms a magnetic path that passes, as indicated by arrows in FIG. 3, the first magnetic core 41, the third magnetic core 43, and the heating belt 26, then passes through the magnetic portion 46*a* (the magnetic region 46*c* in FIG. 5) of the switching belt 46, passes the second magnetic core 42, again passes through the magnetic portion 46*a* of the switching belt 46 and reaches the first magnetic core 41. This generates eddy current in the induction heating layer 26*a* (see FIG. 2) of the heating belt 26 so as to generate Joule heat in the induction heating layer 26*a* by electrical resistance of the induction heating layer 26*a*. Accordingly, the heating belt 26 is properly heated in the maximum paper passing region Smax (see FIG. 5).

Figure 6:
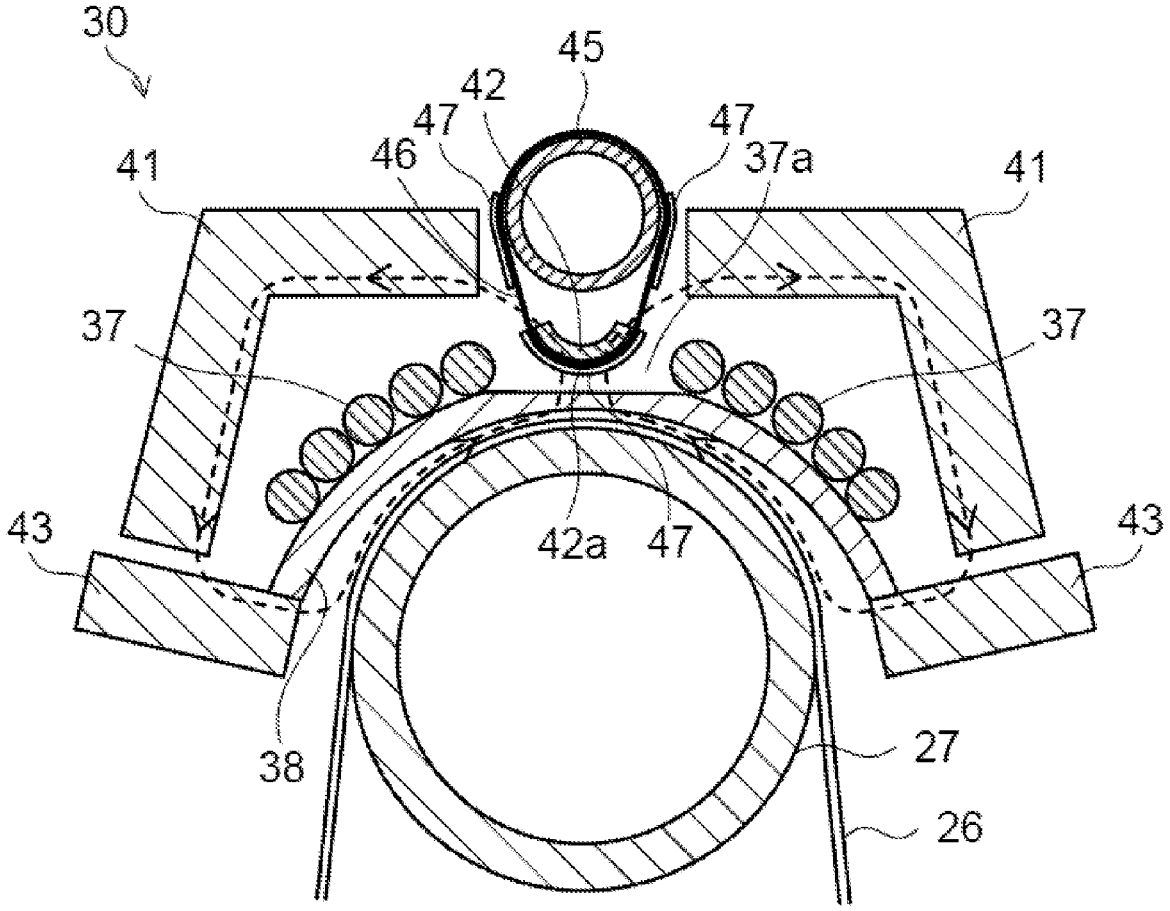
FIG. 6 is a side cross-sectional view illustrating the induction heating unit in a shielded state of a magnetic path in a non-paper passing region of the fixing device according to the embodiment.

FIG. 6 is a side cross-sectional view illustrating the induction heating unit 30 in a state where the magnetic path is shielded in the non-paper passing region. During the fixing process on the printing sheet P with the small width, for example, when a predetermined printing sheet P is selected from an operational panel (not shown), the roller 45 is driven to rotate. This rotation of the roller 45 rotates the switching belt 46 between the roller 45 and the second magnetic core 42. When the detection sensor 51 (see FIG. 5) receives a reflected light from predetermined reflecting surfaces B0, B1, B2, and B3 (see FIG. 5) of the switching belt 46 corresponding to the predetermined printing sheet P, the roller 45 stops rotating and surely stops at the position where the shielding portion 47 of the switching belt 46 faces the protruding portion 42*a* of the second magnetic core 42.

In a rotation stop state of the roller 45, the switching belt 46 is held in the shielding position where a predetermined shielding portion 47 among the first to third shielding portions 47*a* to 47*c* (see FIG. 5) faces the protruding portion 42*a* of the second magnetic core 42. In this case, in the paper passing region of the heating belt 26, as indicated by arrows in FIG. 6, the magnetic flux generated by the coil 37 forms a magnetic path that passes the first magnetic core 41, the third magnetic core 43, and the heating belt 26, then passes through the magnetic portion 46*a* (see FIG. 5) of the switching belt 46, passes the second magnetic core 42, again passes through the magnetic portion 46*a* of the switching belt 46, and reaches the first magnetic core 41. This generates eddy current in the induction heating layer 26*a* (see FIG. 2) of the heating belt 26 so as to generate Joule heat in the induction heating layer 26*a* by electrical resistance of the induction heating layer 26*a*. Accordingly, the heating belt 26 is properly heated in the paper passing region. On the other hand, in the non-paper passing region of the heating belt 26, a path of the magnetic flux generated by the coil 37 is shielded between the heating belt 26 and the second magnetic core 42 by the predetermined shielding portion 47 of the switching belt 46. This reduces heat generation of the heating belt 26 in the non-paper passing region.

As described above, in order to reduce excessive temperature rise in the non-paper passing region, for example, one fixing device includes a shielding member between the coil and the magnetic core in a position facing the non-paper passing region of a small size printing sheet to shield a path of the magnetic flux. During the fixing process on the printing sheet with the small width, disposing the shielding member in the magnetic path shielding position weakens the magnetic flux acting on the non-paper passing region with the shielding member. This reduces heat generation of the heating member in the non-paper passing region.

However, this fixing device may require a wide space for moving the shielding member between the coil and the magnetic core. Accordingly, the size of the device is considered to be increased. Additionally, the increased space between the coil and the magnetic core is considered to reduce the heating efficiency by the induction heating unit.

As described above, another exemplary fixing device includes a coil, which generates a magnetic flux for induction heating at an inner periphery of a heating roller, a shielding member with flexibility disposed between the coil and the inner peripheral surface of the heating roller, and a winding roller, which winds up and houses the shielding member disposed at an end of the heating roller. During a fixing process on a printing sheet with the maximum paper passing width, the shielding member is wound in by the winding roller and then housed. During a fixing process on a printing sheet with a small width, the shielding member is arranged to shield a part of magnetic flux from the coil toward a paper passing portion of the heating roller. This weakens the magnetic flux acting on the non-paper passing region with the shielding member, thus reducing heat generation of the heating roller in the non-paper passing region.

This fixing device may require a space for disposing the winding roller and a member supporting the shielding member with flexibility in the axial direction of the heating roller. Accordingly, the size of the device is considered to be increased. Further, this fixing device may require a wide space for moving the shielding member between the coil and the magnetic core. Accordingly, the size of the device is considered to be increased. Additionally, disposing the member supporting the shielding member at the inner periphery of the heating roller increases a space between the heating roller and the coil. This is considered to reduce the heating efficiency by the induction heating unit.

As described above, another exemplary fixing device includes a coil, a first magnetic core, and a second magnetic core. The coil generates a magnetic flux for induction heating of a heating member. The first magnetic core surrounds the coil and forms a magnetic path. The second magnetic core is disposed in a hollow portion of the loop-shaped coil, and forms a magnetic path. The second magnetic core is rotatable and has a cylindrical cross section. A shielding member is mounted on an outer peripheral surface of the second magnetic core. The shielding member is disposed to face a non-paper passing region at an outer side of a paper passing region of a printing sheet with a small width in a position of a part of the second magnetic core in a peripheral direction. During a fixing process on a printing sheet with the maximum paper passing width, the shielding member is moved to a position most separated from the heating member. During a fixing process on the printing sheet with the small width, rotation of the second magnetic core moves the shielding member to a shielding position close to a surface of the heating member. During the fixing process on the printing sheet with the small width, arranging the shielding member in the shielding position weakens the magnetic flux acting on the non-paper passing region with the shielding member, thus reducing heat generation of the heating member in the non-paper passing region.

In this fixing device, when the second magnetic core rotates and stops at a predetermined position corresponding to the size of the printing sheet, the space between the second magnetic core and the heating member, and the space between the second magnetic core and the first magnetic core may each vary depending on the holding and rotational accuracy of the second magnetic core. Variation of each space with respect to the second magnetic core reduces the heating efficiency of the induction heating unit. When the second magnetic core is stopped in an inclined state in the width direction of the printing sheet, it is considered that the heating distribution may vary in the width direction of the printing sheet.

As described above, another exemplary fixing device includes a first magnetic core and a second magnetic core. The first magnetic core surrounds the coil and forms a magnetic path. The second magnetic core is disposed in a hollow portion of the loop-shaped coil, and forms a magnetic path. An endless belt is suspended between the second magnetic core with a rectangular cross section and a rotationally driving roller. On a surface of the belt, a shielding member that shields a path of the magnetic flux is disposed. The shielding member covers over an area of the second magnetic core corresponding to a non-paper passing region at an outer side of a paper passing region of a printing sheet with a small width. During a fixing process on the printing sheet with the small width, arranging the shielding member in a magnetic path between the second magnetic core and the heating member weakens the magnetic flux acting on the non-paper passing region, thus reducing heat generation of the heating member in the non-paper passing region.

In the configuration of this fixing device, the second magnetic core has the rectangular cross section. The belt with the shielding member is suspended between the roller and the second magnetic core that has the rectangular cross section with a long side at the roller side. Therefore, the roller is arranged to project to the outside of an induction heating unit. Accordingly, the size of the device is considered to be increased.

With the fixing device according to the embodiment of the present disclosure and the image forming apparatus that includes this fixing device, the above-described configuration efficiently heats the heating member without increase in size of the device.

That is, a fixing device according to the embodiment of the present disclosure includes a pressure member, a heating member, a coil, a first magnetic core, a second magnetic core, a shielding portion, and an endless switching belt. The heating member is brought into pressure contact with the pressure member so as to form a nip portion. The coil is wound in a loop shape along a width direction perpendicular to a conveying direction of a recording medium in the heating member to generate a magnetic flux for induction heating of the heating member. The first magnetic core surrounds the coil on an opposite side to the heating member with respect to the coil so as to form a magnetic path. The second magnetic core is disposed to extend in the width direction between the first magnetic core and the heating member in a hollow portion formed by the loop of the coil so as to form a magnetic path with the first magnetic core. The second magnetic core is formed in an arc shape with a protruding portion at a side facing the heating member. The shielding portion is formed of a non-magnetic material to shield a path of the magnetic flux generated by the coil between the second magnetic core and the heating member. The endless switching belt allows passing of the magnetic flux. The switching belt includes a surface where the shielding portion is disposed to face a non-paper passing region in the heating member. The non-paper passing region is a region outside of a paper passing region that allows passing of a recording medium with a smaller width compared with a recording medium with a maximum width to be inserted through the nip portion. The switching belt is suspended to be rotatable between a rotationally driving roller and the protruding portion of the second magnetic core. The rotationally driving roller is disposed at a depressed portion side on an opposite side to the protruding portion of the second magnetic core. The switching belt is configured to be selectively arranged in one of a shielding position and a non-shielding position by rotation of the roller. The shielding position allows the shielding portion to shield the magnetic flux between the second magnetic core and the heating member. The non-shielding position allows passing of the magnetic flux between the second magnetic core and the heating member.

According to the embodiment of the present disclosure, during the fixing process on the recording medium with the maximum width, the switching belt is located in the non-shielding position that allows the magnetic flux to pass between the second magnetic core and the heating member. In the entire region in the width direction of the recording medium, the magnetic flux generated by the coil passes through the magnetic path of the first magnetic core, the heating member, the switching belt, and the second magnetic core. Thus, the heating member is properly heated. During the fixing process on the recording medium with the small width, the switching belt is located in the shielding position. In the paper passing region of the heating member, the magnetic flux generated by the coil passes through the magnetic path of the first magnetic core, the heating member, the switching belt, and the second magnetic core. Thus, the heating member is properly heated. On the other hand, in the non-paper passing region of the heating member, the path of the magnetic flux generated by the coil is shielded between the second magnetic core and the heating member by the shielding portion. This reduces heat generation of the heating member in the non-paper passing region.

With the above-described embodiment, regardless of the size of the printing sheet P to be fixed, the second magnetic core 42 is always secured. This stabilizes the space between the second magnetic core 42 and the first magnetic core 41 and the space between the second magnetic core 42 and the heating belt 26. Accordingly, the induction heating unit 30 can efficiently heat the heating belt 26.

The above-described embodiment has the configuration where the second magnetic core 42 is formed in the arc shape with the protruding portion 42*a* at the side facing the heating belt 26. Therefore, disposing the roller 45 at the depressed portion on the opposite side to the protruding portion 42*a* of the second magnetic core 42 can reduces projection of the roller 45 from the outer peripheral surface of the first magnetic core 41. This suppresses increase in size of the fixing device 5. The configuration where the second magnetic core 42 includes the protruding portion 42*a* reduces the air gap between the second magnetic core 42 and the first magnetic core 41. This efficiently forms a magnetic path in the air gap between the second magnetic core 42 and the first magnetic core 41.

While in the above-described embodiment the configuration where the three shielding portions 47 (the first to third shielding portions 47*a* to 47) are disposed in the switching belt 46 has been described, the embodiment of the present disclosure is not limited to this. The number of the shielding portions 47 may be one or equal to or more than four corresponding to the printing sheet P to be fixed.

While in the above-described embodiment, for example, the case where the shielding portion is disposed corresponding to the non-paper passing region of the standard-sized recording medium has been described as the example, the embodiment of the present disclosure is not limited to this. For example, the embodiment of the present disclosure is also applicable to a fixing device where a custom-sized recording medium is conveyed.

Figure 7:
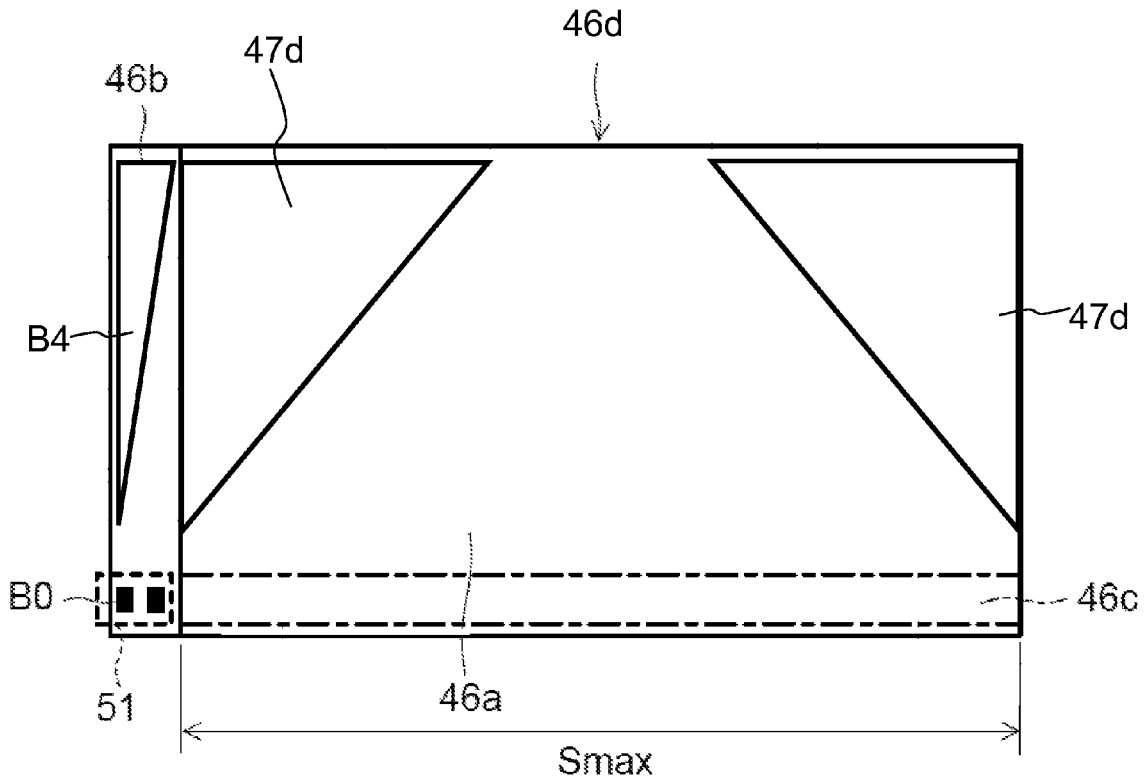
FIG. 7 is a plan view illustrating a switching belt of the fixing device in a rolled-out state according to the embodiment.

In the case where the custom-sized recording medium is conveyed, the following configuration may be employed for example. An exemplary embodiment of the fixing device in this case will be described with reference to FIG. 7. FIG. 7 is a plan view illustrating a switching belt 46*d* of the fixing device in a rolled-out state according to the embodiment. As illustrated in FIG. 7, in this example, a shielding portion 47*d* is disposed on the magnetic portion 46*a* as a shielding portion. The shielding portion 47*d* has a triangular shape in plan view the switching belt 46*d* in the rolled-out state. The shielding portion 47*d* may be disposed to have a length in the width direction of the portion with the widest width such that the length in the width direction is equal to or more than the width direction length of the second shielding portion 47*b* described with reference to FIG. 6. In the example of the embodiment described with reference to FIG. 6, the shielding portions 47*a* to 47*c* are disposed corresponding to the three types of sizes for the recording medium as a recording medium with a width other than the maximum width. In this example, regarding four or more types of sizes for the recording medium as recording mediums with widths other than the maximum width, rotating the switching belt 46*d* allows fixing so that the heating member (the heating belt 26) faces an area with a size corresponding to the non-paper passing region with a corresponding size in the shielding portion 47*d*. This reduces temperature rise in the non-paper passing region. Even in the case where the custom-sized recording medium is conveyed, fixing is performed by rotating the switching belt so that the heating belt 26 faces the area with the size in the width direction corresponding to the size in the width direction of the recording medium in the shielding portion 47*d*. Even in the case where the custom-sized recording medium is conveyed, this reduces temperature rise in the non-paper passing region.

In this example, a reflecting surface B4 as a reflecting portion in the sensing target portion 46*e* may be formed in a triangular shape in plan view for example as illustrated in FIG. 7. In this configuration, the detection sensor is used to detect a rotation position of the switching belt 46*d*, for example, by difference in magnitude of reflectivity. Additionally, for example, the rotation position can be sensed based on a position to sense a reflected light. At this time, for example, the reflecting surface B0 corresponding to the magnetic region 46*c* may be disposed as a reflecting surface similar to the reflecting surface B0 disposed in the switching belt 46 in the embodiment of the preceding example.

The case where the shape of the shielding portion 47*d* is a triangular shape in plan view has been described as the example with reference to FIG. 7. However, the shape of the shielding portion 47*d* is not limited to this. For example, in the example described with reference to FIG. 7, a side corresponding to the oblique side of the shielding portion 47*d* may be formed in a curved line. That is, unlike the shielding portion 47*d*, a width of an area corresponding to the non-paper passing region need not to linearly vary along the peripheral direction. For example, this width may be constituted to increase (or decrease) along the peripheral direction (that is, from one side toward the other side in the peripheral direction) regardless of linearly or nonlinearly. Alternatively, the part corresponding to the oblique side may be formed in a staircase pattern. In this case, increasing the number of steps in the staircase pattern also allows appropriate fixing corresponding to the recording mediums in various sizes.

In the case of using the switching belt 46 in the preceding example, when any of the shielding portions 47*a* to 47*c* faces the non-paper passing region, the size in the width direction (that is, the size in the width direction of the area facing the protruding portion 42*a* in the shielding portions 47*a* to 47*c*) may have the same size along the peripheral direction by driving of the switching belt 46. However, in this example, the size in the width direction of the shielding portion 47*d* varies along the peripheral direction. Therefore, the length in the width direction of the area facing the non-paper passing region (that is, the size in the width direction of the area facing the protruding portion 42*a* in the shielding portion 47*d*) varies along the peripheral direction. Accordingly, in the area facing the protruding portion 42*a*, the degree of the shielding effect in the width direction of the shielding portion 47*d* may vary along the peripheral direction. Even in this case, the area facing the shielding portion 47*d* of the heating belt 26 can be heated by the magnetic flux from the area of the magnetic portion 46*a* adjacent to the shielding portion 47*d* in the width direction. This allows the configuration that does not substantially cause problems with the fixing effect and the shielding effect.

Also in the case of using the switching belt 46 described with reference to FIG. 6, a custom-sized recording medium is accommodated. For example, it may be configured to allow the heating member to face a shielding portion with a similar size in the width direction of the non-paper passing region among the shielding portions 47*a* to 47*c* so as to effectively provide a shielding effect on the custom-sized recording medium.

The size of the printing sheet may be input by a user. Alternatively, the size of the printing sheet may be sensed by disposing a media sensor or similar sensor. The media sensor can employ, for example, an optical media sensor in a linear shape extending in the entire region or half region in the width direction.

In the above-described embodiments, in the fixing device, the recording medium with any size is conveyed so that the center in the width direction passes through the center of the fixing device in the width direction. The non-paper passing regions are disposed at both the ends in the width direction. Therefore, the shielding portions are disposed at both the ends on the switching belt 46 in the width direction. However, the embodiment of the present disclosure is applicable to another fixing device. For example, the recording medium with any size may be conveyed so that one side of the recording medium extending in the conveying direction at one end side in the width direction passes through the one end side of the fixing device in the width direction. In this case, the non-paper passing region is disposed, for example, at the other end side in the width direction. Therefore, the shielding portion may be disposed, for example, at the other end side in the width direction of the switching belt, corresponding to this non-paper passing region.

While in the above-described embodiments the application examples of the fixing device 5 where the heating belt 26 is suspended between the fixing roller 23 and the suspension roller 27 have been described, the example of the embodiment of the present disclosure is not limited to these. The embodiment of the present disclosure is applicable to the fixing device 5 where the heating belt 26 is stretched on the fixing roller 23 or to the fixing device 5 that includes: the pressure roller 19 brought into pressure contact with the outer peripheral surface of the heating belt 26, and a pressing member disposed on the inner peripheral surface of the heating belt 26 to bring the printing sheet P and the heating belt 26 into pressure contact with each other. Furthermore, the embodiment of the present disclosure is applicable to various types of electromagnetic induction heating type fixing devices such as the fixing device 5 that includes the pressure roller 19 and a heating roller brought into pressure contact with the pressure roller 19. The heating roller includes an induction heating layer in its inside, and is disposed to face the induction heating unit.

The embodiment of the present disclosure may be used in a fixing device and an image forming apparatus that includes this fixing device, especially, in an electromagnetic induction heating type fixing device and an image forming apparatus that includes this fixing device.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A fixing device, comprising:

a pressure member;

a heating member configured to be brought into pressure contact with the pressure member so as to form a nipping area;

a coil wound in a looped form running widthwise along the heating member orthogonal to a recording-medium conveyance direction, the coil therein configured to generate, under a current passing through the coil, magnetic flux inductively heating the heating member;

a first magnetic core surrounding the coil to form a magnetic path on a side of the coil opposite from the heating member;

a second magnetic core provided extending widthwise between the first magnetic core and the heating member in a hollow area formed by the loop of the coil, so as to form a magnetic path together with the first magnetic core, the second magnetic core being formed in an arcuate shape having a protruding portion along a side of the second magnetic core facing the heating member;

a rotationally driving roller disposed alongside a recessed portion of the second magnetic core on a side of the second magnetic core reverse from the protruding portion;

a shielding portion formed of a non-magnetic material to shield a path of the magnetic flux generated by the coil between the second magnetic core and the heating member; and an endless switching belt permeable to magnetic flux, the switching belt including a surface on which the shielding portion is provided, facing a sheet non-passing region of the heating member, the sheet non-passing region being a region outside a sheet-passing region through which recording media of width smaller than maximum-width recording media inserted through the nipping area pass, the switching belt being rotatably suspended between the rotationally driving roller and the protruding portion of the second magnetic core, and being configured to be selectively disposed, by rotation of the driving roller, in one of either a shielding position or a non-shielding position, whereby the shielding portion in the shielding position blocks magnetic flux between the second magnetic core and the heating member, and in the non-shielding position allows passing of magnetic flux between the second magnetic core and the heating member.

2. The fixing device according to claim 1, wherein a plurality of the shielding portions are disposed corresponding to a plurality of widths for smaller-width recording media inserted through the nipping area, widthwise dimensions of the plurality of widths being different from each other.

3. The fixing device according to claim 1, further comprising a position sensing unit configured to sense the position where the switching belt is selectively disposed.

4. The fixing device according to claim 3, wherein the switching belt includes a sensing target portion sensed by the position sensing unit, the sensing target portion being formed at a widthwise end of the switching belt.

5. The fixing device according to claim 3, wherein the position sensing unit includes a light projecting portion, a reflecting portion, and a light receiving portion, the reflecting portion being disposed on the switching belt, the light receiving portion being configured to receive reflected beam of light emitted from the light projecting portion, reflected by the reflecting portion.

6. The fixing device according to claim 1, wherein:

a plurality of the shielding portions are disposed corresponding to a plurality of widths for smaller-width recording media inserted through the nipping area, widthwise dimensions of the plurality of widths being different from each other; and a magnetic region is provided on the switching belt, over an entire widthwise span of the switching belt in at least a part of intervals between the plurality of the shielding portions along the switching belt peripherally.

7. The fixing device according to claim 6, further comprising a position sensing unit configured to sense the position where the switching belt is selectively disposed; wherein:

the switching belt includes a sensing target portion sensed by the position sensing unit, the sensing target portion being formed at a widthwise end of the switching belt;

the position sensing unit includes a light projecting portion, a reflecting portion, and a light receiving portion, the reflecting portion being disposed on the switching belt, the light receiving portion being configured to receive reflected beam of light emitted from the light projecting portion, reflected by the reflecting portion; and the reflecting portion includes a plurality of reflecting portions disposed corresponding to the plurality of the shielding portions and the magnetic region.

8. The fixing device according to claim 1, wherein the switching belt is formed of a magnetic sheet, and the shielding portion is formed on the magnetic sheet using an electroconductive non-magnetic material.

9. An image forming apparatus, comprising:

a fixing device including a pressure member;

a heating member configured to be brought into pressure contact with the pressure member so as to form a nipping area;

a coil wound in a looped form running widthwise along the heating member orthogonal to a recording-medium conveyance direction, to generate magnetic flux inductively heating the heating member;

a first magnetic core surrounding the coil to form a magnetic path on a side of the coil opposite from the heating member so as;

a second magnetic core provided extending widthwise between the first magnetic core and the heating member in a hollow area formed by the loop of the coil, so as to form a magnetic path together with the first magnetic core, the second magnetic core being formed in an arcuate shape having a protruding portion along a side of the second magnetic core facing the heating member;

a rotationally driving roller disposed alongside a recessed portion of the second magnetic core on a side of the second magnetic core reverse from the protruding portion;

a shielding portion formed of a non-magnetic material to shield a path of the magnetic flux generated by the coil between the second magnetic core and the heating member; and an endless switching belt permeable to magnetic flux, the switching belt including a surface provided with the shielding portion facing a sheet non-passing region of the heating member, the sheet non-passing region being a region outside a sheet-passing region through which pass recording media of width smaller than maximum-width recording media inserted through the nipping area, the switching belt being rotatably suspended between the rotationally driving roller and the protruding portion of the second magnetic core, and being configured to be selectively disposed, by rotation of the driving roller, in one of either a shielding position or a non-shielding position, the shielding position allowing the shielding portion to block magnetic flux between the second magnetic core and the heating member, and the non-shielding position allowing passing of magnetic flux between the second magnetic core and the heating member.

10. The image forming apparatus according to claim 9, wherein a plurality of the shielding portions are disposed corresponding to a plurality of widths for smaller-width recording media inserted through the nipping portion, widthwise dimensions of the plurality of widths being different from each other.

11. The image forming apparatus according to claim 9, further comprising a position sensing unit configured to sense the position where the switching belt is selectively disposed.

12. The image forming apparatus according to claim 11, wherein the switching belt includes a sensing target portion sensed by the position sensing unit, the sensing target portion being formed at a widthwise end of the switching belt.

13. The image forming apparatus according to claim 11, wherein the position sensing unit includes a light projecting portion, a reflecting portion, and a light receiving portion, the reflecting portion being disposed on the switching belt, the light receiving portion being configured to receive reflected beam of light emitted from the light projecting portion, reflected by the reflecting portion.

14. The image forming apparatus according to claim 9, wherein:

a plurality of the shielding portions are disposed corresponding to a plurality of widths for smaller-width recording media inserted through the nipping area, widthwise dimensions of the plurality of widths being different from each other; and a magnetic region is provided on the switching belt, over an entire widthwise span of the switching belt in at least a part of intervals between the plurality of the shielding portions along the switching belt peripherally.

15. The image forming apparatus according to claim 14, further comprising a position sensing unit configured to sense the position where the switching belt is selectively disposed; wherein:

the switching belt includes a sensing target portion sensed by the position sensing unit, the sensing target portion being formed at a widthwise end of the switching belt;

the position sensing unit includes a light projecting portion, a reflecting portion, and a light receiving portion, the reflecting portion being disposed on the switching belt, the light receiving portion being configured to receive reflected beam of light emitted from the light projecting portion, reflected by the reflecting portion; and the reflecting portion includes a plurality of reflecting portions disposed corresponding to the plurality of the shielding portions and the magnetic region.

16. The image forming apparatus according to claim 9, wherein the switching belt is formed of a magnetic sheet, and the shielding portion is formed on the magnetic sheet using an electroconductive non-magnetic material.

* * * * *